US006696390B1

(12) United States Patent
Hatada et al.

(10) Patent No.: US 6,696,390 B1
(45) Date of Patent: Feb. 24, 2004

(54) IMAGE TRANSFER SHEET, METHOD FOR FORMING IMAGE ON THE IMAGE TRANSFER SHEET AND IMAGE TRANSFER METHOD USING THE IMAGE TRANSFER SHEET

(75) Inventors: Shigeo Hatada, Numazu (JP); Keishi Taniguchi, Susono (JP)

(73) Assignee: Ricoh Company, Ltd., Tokyo (JP)

( * ) Notice: Subject to any disclaimer, the term of this patent is extended or adjusted under 35 U.S.C. 154(b) by 39 days.

(21) Appl. No.: 09/665,428

(22) Filed: Sep. 20, 2000

(30) Foreign Application Priority Data

Sep. 20, 1999 (JP) ..... 11-265019

(51) Int. Cl.[7] ..... B41M 5/00; B41M 5/035; B41M 5/38

(52) U.S. Cl. ..... 503/227; 156/235; 347/105; 428/31.12; 428/31.51; 430/48

(58) Field of Search ..... 428/195, 448.1, 428/446, 447, 480, 484, 913, 914, 32.12, 32.51; 156/235; 347/105; 503/227; 430/48

(56) References Cited

U.S. PATENT DOCUMENTS

| | | | | | |
|---|---|---|---|---|---|
| 4,780,348 | A | * | 10/1988 | Yamamato et al. | 428/43 |
| 5,006,502 | A | * | 4/1991 | Fujimara et al. | 503/227 |
| 5,981,077 | A | * | 11/1999 | Taniguchi | 428/447 |
| 6,042,984 | A | * | 3/2000 | Taniguchi | 430/126 |
| 6,103,042 | A | * | 8/2000 | Hatada et al. | 156/235 |

FOREIGN PATENT DOCUMENTS

| | | | | |
|---|---|---|---|---|
| JP | 52-82509 | | 7/1977 | |
| JP | 08025788 | | 1/1996 | |
| JP | 10-053000 | * | 2/1998 | B44C/1/17 |
| JP | 11-002915 | * | 1/1999 | G03G/7/00 |
| JP | 11-70794 | * | 3/1999 | B44C/1/165 |

* cited by examiner

*Primary Examiner*—B. Hamilton Hess
(74) *Attorney, Agent, or Firm*—Oblon, Spivak, McClelland, Maier & Neustadt, P.C.

(57) ABSTRACT

An image transfer sheet including a substrate, an image transfer layer formed overlying one side of the substrate, and a surface layer which is formed overlying the transfer layer and which includes a resin, wherein the resin has a glass transition temperature of from 27° C. to 100° C.

45 Claims, 2 Drawing Sheets

IMAGE TRANSFER SHEET, METHOD FOR FORMING IMAGE ON THE IMAGE TRANSFER SHEET AND IMAGE TRANSFER METHOD USING THE IMAGE TRANSFER SHEET

BACKGROUND OF THE INVENTION

1. Field of the Invention

The present invention relates to an image transfer sheet which transfers an image formed thereon onto a receiving material. More particularly, the present invention relates to an image transfer sheet which transfers an image, which is formed thereon using an image forming apparatus such as electrophotographic copiers, thermal printers and ink jet printers, onto a receiving material such as cloth, canvas, plastics, paper, wood, leather, glass, china, metal and the like. In addition, the present invention relates to a method for forming an image on the image transfer sheet, and a method for transferring an image formed on the image transfer sheet on a receiving material.

2. Discussion of the Background

Recently, a variety of image forming apparatus have been developed and utilized for copiers and printers. These image forming apparatus include, for example, electrophotographic copiers in which a toner image formed on an image bearing member is transferred onto a receiving material, and thermal printers in which an ink image is formed on a receiving material by imagewise heating a thermal transfer recording material or a sublimation thermal transfer recording material. In addition, inkjet printers in which an image is formed on a receiving material by imagewise shooting an aqueous ink or an ink fused by heat are used as image forming apparatus. The images formed by these image forming apparatus are not only used for a purpose of reading or viewing, but also are tried to be applied for various new applications.

As one of these new applications of the images, a method is proposed in which the images are transferred onto an image receiving material such as cloth, leather, canvas, plastics, paper, wood, glass, china, metals or the like. This method is useful for manufacturing a small lot of made-to-order goods having original pictures thereon, such as T-shirts, sweat shirts, aprons, jackets, cups, plates or stained glass, and for manufacturing small lot of pictures duplicated on canvases, which are mainly manufactured for individuals. Currently, since full color copiers are developed and thereby high quality full color images can be easily obtained, the demand for this method is increasing more and more.

An image transfer sheet used for the image forming method in which toner images formed on the image transfer sheet are transferred onto such an image receiving material mentioned above is discussed, for example, in Japanese Laid-Open Patent Publication No. 52-82509. This Publication discloses an image transfer sheet including an adhesive layer, which is formed on a supporter and which consists of an adhesive selected from the group consisting of silicones and fluorine-containing polymers, and an under coat layer, which is formed on the adhesive layer and which consists of a polymer meltable at a relatively low temperature. When a toner image, which has been formed on the undercoat layer of the image transfer sheet, is brought into contact with a receiving material such as cloth etc. while being heated and pressed, the toner image is transferred onto the receiving material together with the undercoat layer.

In Japanese Laid-Open Patent Publication No. 52-82509, the polymer meltable at a relatively low temperature for use in the undercoat layer (which corresponds to the image transfer layer in the present invention) is selected from the group consisting of polyvinyl chloride, polyvinyl acetate, polymethyl methacrylate, polyethyl methacrylate, polybutyl methacrylate, polyvinylidene chloride and their mixtures, compounds, and copolymers. These materials can be preserved at room temperature without causing problems. However, when the materials are preserved at a relatively high temperature (50° C.), the undercoat layer softens, resulting in occurrence of a blocking problem in which the undercoat layer and the other surface of the transfer sheet adhere to each other when the sheet is wound like a roll. When a silicone oil is added to the undercoat layer to avoid the blocking problem, the feeding rollers in an image forming apparatus tend to slip, resulting in occurrence of a problem in which the transfer sheet is mis-fed or jammed in the image forming apparatus. Therefore a need exists for an image transfer sheet having a combination of good preservation property and good feeding property.

In attempting to provide such an image transfer sheet, Japanese Laid-Open Patent Publication No. 8-25788 discloses a technique in which a release layer (corresponding to the backcoat layer in the present invention) constituted of a material such as silicone compounds (e.g., silicone copolymers and silicone resin mixtures), and non-silicone compounds such as polyolefins, waxes, alkyd resins, resins having a long chain alkyl group, fluorine-containing resins, and shellac, is formed on the side of the transfer sheet opposite to the side on which the image transfer layer is formed. However, the feeding property of the sheet in image forming apparatus is not considered in this case.

In addition, in this case the image transfer layer has insufficient adhesion with the receiving materials mentioned above. For, example, an image formed on the image transfer layer is transferred on a T-shirt, a problem which occurs is that the image tends to be peeled from the T-shirt after several washing. In particular, when a release material is included in an image transfer layer, the adhesion of the image transfer layer to a receiving material deteriorates. When a release layer including a release material is formed on the backside of the transfer sheet, the release material tends to be transferred onto the image transfer layer depending on the species of the release material because the transfer sheet is typically wound like a roll. Therefore the adhesion of the image transfer layer to a receiving material also deteriorates.

In order to prevent the blocking problem, a technique in which a resin having a high transition temperature is used in an image transfer layer is proposed. However, the adhesion of such an image transfer layer to a receiving material tends to deteriorate, and in addition, the image transfer layer, which has been transferred onto a receiving material, tends to be cracked when a force is applied thereto.

Because of these reasons, a need exists for an image transfer sheet having a combination of good blocking resistance and good fixing property.

SUMMARY OF THE INVENTION

Accordingly, an object of the present invention is to provide an image transfer sheet having a combination of good blocking resistance and good fixing property.

Another object of the present invention is to provide an image transfer sheet having good feeding property in image forming apparatus.

Yet another object of the present invention is to provide an image forming method in which an image is formed on the image transfer sheet without causing feeding problems.

A further object of the present invention is to provide an image transfer method in which an image having good fixing property is transferred on a receiving material such as cloth, canvas, plastics, paper, wood, leather, glass, china and metals.

Briefly these objects and other objects of the present invention as hereinafter will become more readily apparent can be attained by an image transfer sheet in which at least an image transfer layer and a surface layer are overlaid on a substrate in this order, wherein the surface layer includes a resin, and wherein the resin has a glass transition temperature (Tg) of from 27 to 100° C.

The resin preferably includes a resin selected from the group consisting of polyester resins, acrylic resins, styrene-acrylic resins, and butyral resins.

The surface layer may include two or more resins. In this case, the weighted average glass transition temperature of the resins is from 27 to 100° C.

In addition the thickness of the surface layer is from 0.1 to 10 $\mu$m.

The image transfer sheet preferably has a backcoat layer on the side of the substrate opposite to the side on which the image transfer layer and surface layer are formed.

In another aspect on the present invention, an image forming method is provided which includes the steps of forming an image formed of a toner on the image transfer sheet mentioned above, and fixing the toner image upon application of at least one of heat or pressure.

The image may be formed of an ink such as a thermofusible ink, a sublimation dye ink or an ink for ink jet printing. When these inks are used for the image, heat and/or pressure are not necessarily applied to the image.

In yet another aspect on the present invention, an image transfer method is provided which includes the steps of preparing an image transfer sheet in which a transfer layer and a surface layer are overlaid on a substrate in this order and in which an image is formed on the surface layer, then bringing the image transfer sheet into contact with a receiving material such that the image contacts the receiving material upon application of heat and pressure, and then peeling the substrate from the image transfer sheet to transfer the image on the receiving material together with the image transfer layer and the surface layer, wherein the image transfer sheet is the image transfer sheet mentioned above.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
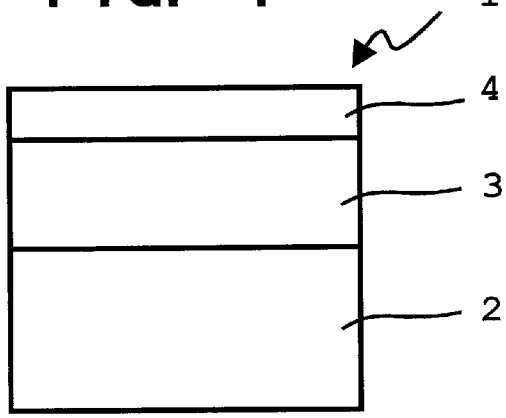
FIG. 1 is a schematic view illustrating a cross section of an embodiment of the image transfer sheet of the present invention.

FIG. 1 is a schematic view illustrating a cross section of an embodiment of the image transfer sheet of the present invention. In FIG. 1, an image transfer sheet 1 has a substrate 2, an image transfer layer 3 formed on the substrate 2, and a surface layer 4 formed on the image transfer layer 3. The surface layer 4 includes a resin having a glass transition temperature (Tg) of from 27 to 100° C.

Figure 2:
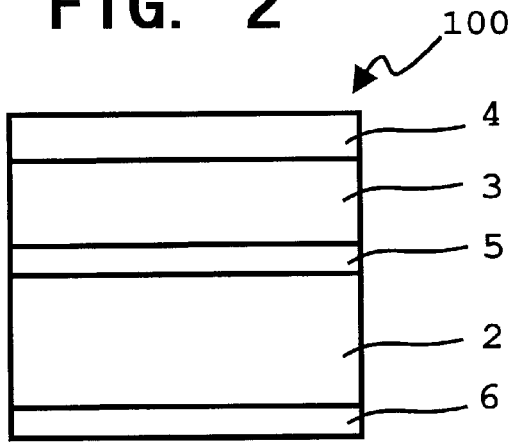
FIG. 2 is a schematic view illustrating a cross section of another embodiment of the image transfer sheet of the present invention.

FIG. 2 is a schematic view illustrating a cross section of another embodiment of the image transfer sheet of the present invention. In FIG. 2, an image transfer sheet 100 has a substrate 2, a release layer 5 formed on the substrate 2, an image transfer layer 3 formed on the release layer 5, and a surface layer 4 formed on the image transfer layer 3. In addition, on the backside of the substrate 2, a backcoat layer 6 is formed. The structure of the image transfer sheet of the present invention is not limited thereto if a surface layer and an image transfer layer are included therein.

Preferably, the release layer 5 includes a silicone compound.

Figure 3:
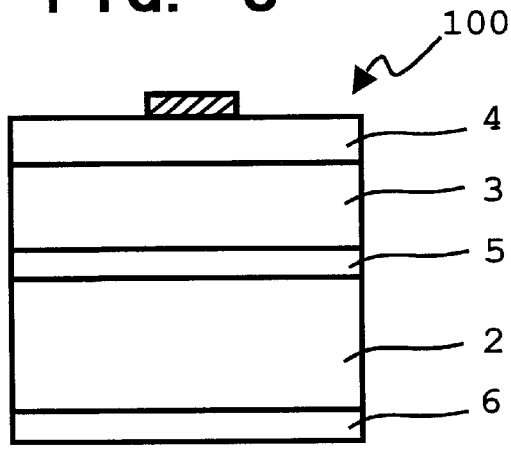
FIG. 3 is a schematic view illustrating the image transfer sheet as shown in FIG. 2 on which an image is formed.

As shown in FIG. 3, on the surface layer 3, an image 10 is formed by, for example, an electrophotographic image forming method using a toner, a thermal transfer recording method using a thermofusible ink or a sublimation dye, or an ink jet printing method using an aqueous ink or a thermofusible ink. When the image is a toner image, the toner image is fixed on the surface layer upon application of heat and/or pressure.

Figure 4A:
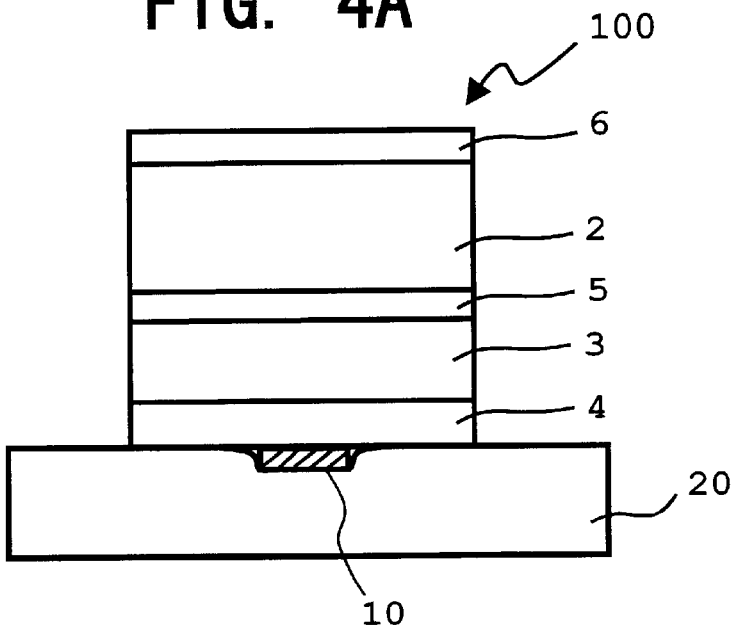
FIGS. 4A and 4B are views for explaining how the image formed on the image transfer sheet as shown in FIG. 3 is transferred on a receiving material.
Figure 4B:
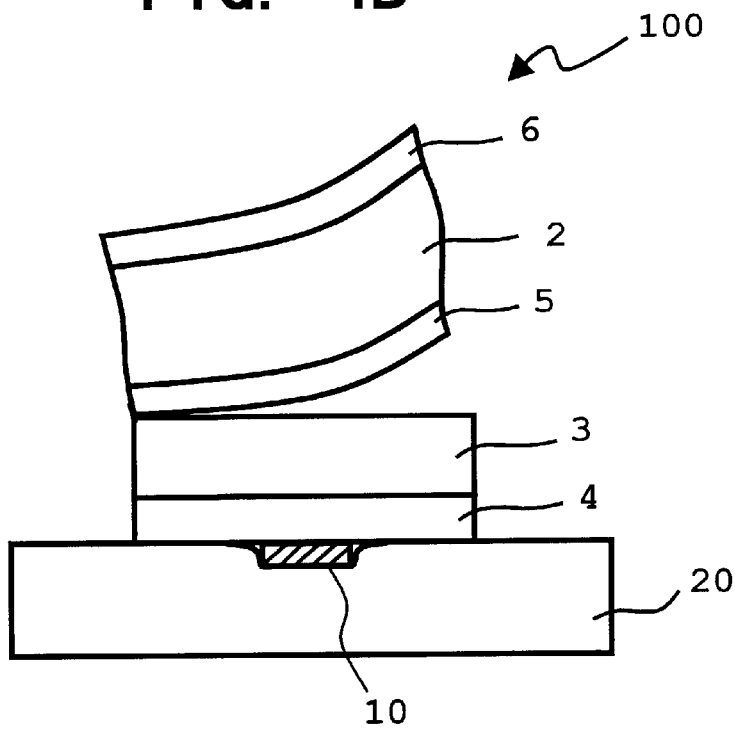

As shown in FIG. 4A, the image 10 formed on the surface layer 4 is then transferred onto a receiving material 20 upon application of heat and/or pressure. After the image transfer sheet 100 is cooled, the substrate 2 (including the release layer 5 and backcoat layer 6) is peeled from the image transfer layer 3 as shown in FIG. 4B. Thus a combination of the transfer layer 3 and the surface layer 4 having the image 10 is transferred on the receiving material 20.

The surface layer includes a resin having a glass transition temperature (Tg) of from 27° C. to 100° C., and preferably from 27° C. to 60° C. to provide an image transfer sheet having a combination of good blocking resistance, good feeding property and good fixing property. When the resin included in the surface layer 3 has a glass transition temperature less than 27° C., the blocking resistance of the resultant image transfer sheet deteriorates. On the contrary, when the resin in the surface layer 3 has a glass transition temperature greater than 100° C., the surface layer tends to be easily cracked.

The surface layer may include two or more resins. In this case, the weighted average glass transition temperature of the resins is from 27° C. to 100° C. For example, when a resin A having a glass transition temperature Tg (A) and a resin B having a a glass transition temperature Tg(B) are included in the surface layer in a weight ratio of 0.6/0.4, the weighted average glass transition temperature Tg of the resins is represented as follows:

$$Tg=Tg(A)\times 0.6+Tg(B)\times 0.4.$$

Suitable resins for use in the surface layer include polyester resins, acrylic resins, styrene-acrylic resins, butyral resins and the like resins. These resins have a relatively large friction coefficient compared to silicone resins and silicone rubbers, which are typically used for a backcoat layer of image transfer sheets. Therefore, the resultant image transfer sheet hardly causes mis-feeding in image forming apparatus when an image to be transferred is formed on the surface layer using the image forming apparatus.

When an image is transferred on a receiving material, the image is transferred together with the transfer layer and the surface layer. Therefore, the fixing property of the image on the receiving material is hardly different from the fixing property in a case in which an image transfer sheet having no surface layer is used. In addition, the image can be clearly transferred on the receiving material because the image is hardly damaged when the image transfer sheet is heated and/or pressed to transfer the image onto the receiving material.

In the present invention, the glass transition temperature (Tg) is measured using a thermal analyzing system EXSTAR 6000 (including a differential scanning calorimeter DSC 220, and other devices such as a differential thermal analyzer (DTA) and a computer) manufactured by Seiko Instruments Inc., a Japanese company. The temperature rising speed is 10° C./min.

When the glass transition temperature of a surface layer of an image transfer sheet is measured, the surface layer is shaved using a sharp knife. Then glass transition temperature of the thus obtained surface layer is measured using the analyzer mentioned above.

The material for use in the surface layer preferably has good transparency, and good adhesion (fixability) to toner images, and ink images formed on the surface layer.

In the image transfer sheet of the present invention, the following materials can be used in the surface layer within an amount such that they do not deteriorate the good blocking resistance, good fixing property and good feeding property of the image transfer sheet of the present invention.

Specific examples of such materials include thermoplastic polyurethane resin, polyamide resins, polyolefin resins, cellulose derivatives such as nitrocellulose, styrene resins such as polystyrene resins and poly-methylstyrene, vinyl copolymers such as vinyl chloride-vinyl acetate copolymers and ethylene-vinyl alcohol copolymers, rosin resins such as rosin and rosin ester resins (e.g., maleic acid resins modified rosin), natural or synthetic rubbers such as polyisoprene rubbers and styrene-butadiene rubbers, ionomer resins, epoxy resins, phenolic resins, and the like resins.

The thickness of the surface layer is preferably from 0.1 to 10 $\mu$m, and more preferably from 0.2 to 5 $\mu$m. When the thickness of the surface layer is too thin, the blocking resistance of the resultant image transfer sheet is insufficient. On the contrary, when the thickness is too thick, the surface layer tends to be cracked, and in addition, the fixing property tends to deteriorate.

Then the image transfer layer will be explained.

As the material for use in the image transfer layer, the materials mentioned above for use in the surface layer can be used alone or in combination. However, it is preferable for the image transfer layer to include a self-crosslinking polymer to enhance the heat resistance and fixing property of the image transferred on a receiving material. Namely, even when the image transferred on a receiving material together with such an image transfer layer is heated, the image is not softened or melted because the image transfer layer is crosslinked by the heat applied in the image transfer process.

Suitable self-crosslinking polymers include polymers having a self-crosslinking group such as a methylol group, an alkoxymethyl group, a carboxyl group, an epoxy group, a hydroxy group, an amide group, a methylol acrylamide group and a vinyl group. Among these polymers, polymers having a methylol group and/or an alkoxymethyl group are preferable because the resultant transfer sheet has a combination of good preservation stability and good crosslinking ability. In particular, ethylene-vinyl acetate-acrylic copolymers having a methylol group and/or an alkoxymethyl group are more preferably used.

The self-crosslinking polymers having a crosslinking temperature of from 80° C. to 250° C. are preferably used for the image transfer layer to prepare an image transfer sheet having a combination of good preservation stability and good crosslinking ability. In addition, the molecular weight of the self-crosslinking polymers for use in the image transfer layer is preferably from 10,000 to 500,000 to impart good fixing ability to various receiving materials to the resultant transfer sheet.

In addition, it is preferable to use a self-crosslinking polymer having a glass transition temperature (Tg) not lower than 0° C. and a self-crosslinking polymer having a glass transition temperature lower than 0° C. and/or a self-crosslinking polymer having a weight average molecular weight of from 10,000 to 500,000 and a self-crosslinking polymer having a weight average molecular weight of from 10,000,000 to 60,000,000. The image transfer sheet having such a transfer layer has a combination of good fixing ability to various receiving materials and good feeding property in image forming apparatus when an image is formed thereon by the apparatus. The mixing ratio of a self-crosslinking polymer having glass transition temperature not lower than 0° C. to a self-crosslinking polymer having a glass transition temperature lower than 0° C. is 1/10 to 10/1 by weight. The mixing ratio of a self-crosslinking polymer having a weight average molecular weight of from 10,000 to 500,000 and a self-crosslinking polymer having a weight average molecular weight of from 10,000,000 to 60,000,000 is 1/10 to 10/1 by weight.

The thickness of the image transfer layer is preferably from 5 to 100 $\mu$m, and more preferably from 10 to 50 $\mu$m. When the thickness is too thin, the physical strength of the image transfer layer is insufficient, and therefore the image transfer layer tends to wrinkle or break when an image is transferred to a receiving material. On the contrary, when the thickness is too thick, the transferred image looks unnatural, and in addition mis-feeding tends to occur when an image is formed on the image transfer sheet in image forming apparatus.

In the surface layer and the image transfer layer, additives such as tackifiers, antioxidants, colorants, antistatic agents, flame retardants, waxes, plasticizers, fillers and the like can be included if desired.

In the transfer sheet of the present invention, a release layer including a silicone compound is preferably formed between the substrate and the image transfer layer so that the substrate can be easily peeled from the image transfer layer after an image formed on the sheet is transferred on a receiving material.

Suitable silicone compounds for use in the release layer include methyl silicone resins, phenyl methyl silicone resins, silicone alkyd resins, silicone epoxy resins, silicone resins modified by a polyester resin, silicone resins modified by a urethane resin, silicone resins modified by an acrylic resin, silicone resins modified by a melamine resin, silicone resins modified by a phenolic resin, dimethyl silicone rubbers, methyl vinyl silicone rubbers, methyl phenyl silicone rubbers, and the like. These materials can be used alone or in combination.

In particular, by including a room temperature crosslinking silicone rubber in the release layer, the release layer can be crosslinked without performing an additional heating operation for only crosslinking, resulting in preparation of the image transfer sheet at a low manufacturing cost. In addition, the resultant release layer has a high degree of crosslinking. Therefore, the substrate can be easily peeled from the image transfer layer even after the image transfer layer heated and pressed for transferring an image is cooled. This is because the release layer does not mix with the transfer layer even when heated and pressed (i.e., the interface between the release layer and the image transfer layer is maintained as the initial state even when heated and pressed) Therefore, the image transfer sheet of the present invention does not have the following drawbacks of the conventional transfer sheets:

(1) it is needed to peel a substrate from an image transfer layer while the image transfer sheet is hot when transferring an image; and (2) when a large-sized image is transferred, a uniform and high quality image cannot be obtained because the transferring property of the image transfer sheet changes at an initial peeling point and at a final peeling point due to change of the temperature of the image transfer sheet.

In the release layer, thematerials for use in the transfer layer mentioned above can be included in an amount such that the resultant image transfer sheet does not lose the advantages in the present invention.

The thickness of the release layer is preferably from 0.05 to. 5.0 $\mu$m. When the release layer is too thin, the resultant image transfer sheet has insufficient releasing ability. When the release layer is too thick, the resultant image transfer sheet has a high manufacturing cost and insufficient releasing ability.

The image transfer sheet of the present invention has good blocking resistance because the surface layer is formed. If desired, a backcoat layer may be formed on the side of the substrate opposite to the side on which the image transfer layer and the surface layer are formed, to effectively avoid the blocking problem. Suitable materials for use in the backcoat layer include silicone compounds which are not liquid at room temperature. When a liquid silicone compound is included in the backcoat layer, the feeding property of the resultant transfer sheet deteriorates because the liquid silicone compound adheres to a feeding roller in image forming apparatus. In addition, the fixing property of the image formed on a receiving material deteriorates because the silicone compound transfers to the surface of the surface layer when the image transfer sheet is wound.

Specific examples of the silicone compounds for use in the backcoat layer include methyl silicone resins, phenyl methyl silicone resins, silicone alkyd resins, silicone epoxy resins, silicone resins modified by a polyester resin, silicone resins modified by a urethane resin, silicone resins modified by an acrylic resin, silicone resins modified by a melamine resin, silicone resins modified by a phenolic resin, dimethyl silicone rubbers, methyl vinyl silicone rubbers, methyl phenyl silicone rubbers, and the like. These compounds can be used alone or in combination.

Among the silicone compounds, silicone rubbers, and mixtures of a silicone rubber and a silicone resin are preferably used. Silicone rubbers has a relatively large friction coefficient compared to silicone resins, and therefore the resultant image transfer sheet can be stably fed by feeding rollers in image forming apparatus when an image is transferred on the image transfer sheet. In particular, room temperature crosslinking silicone rubbers, and mixtures of a room temperature silicone rubber and a silicone resin are preferably used for the release layer. Mixtures of a room temperature silicone rubber and a silicone resin in a weight ratio of from 100/0 to 20/80 are more preferable. When the concentration of a silicone resin is greater than 80% by weight, the blocking problem tends to occur.

The backcoat layer may include the additives mentioned above for use in the image transfer layer in an amount that the resultant image transfer sheet does not lose its advantages.

The weight of the backcoat layer is preferably from 0.1 to 10 g/m$^2$, and more preferably from 0.3 to 5 g/m$^2$, to impart good blocking resistance and good feeding property to the resultant image transfer sheet, and to avoid increase of the manufacturing cost.

In addition, by including a room temperature crosslinking silicone rubber or a combination of a room temperature crosslinking silicone rubber and a silicone resin in the backcoat layer, the backcoat layer can be crosslinked without performing an additional heating operation for only crosslinking, resulting in preparation of the image transfer sheet at a low manufacturing cost.

Suitable materials for use as the substrate of the transfer sheet of the present invention include paper, synthetic paper, cloth, nonwoven fabric, leather, sheets of a resin such as polyethylene terephthalate, diacetate cellulose, triacetate cellulose, acrylic resins, cellophane, celluloid, polyvinyl chloride, polycarbonate, polyimide, polyethersulfone, polyethyl ether ketone, polyethylene, and polypropylene; metal plates, metal foils and the like. These materials can be used alone or in combination (i.e., as a complex film in which two or more sheets of these materials are laminated). In addition, these materials may be subjected to a treatment imparting waterproof property, electroconductive property and/or the like to the materials. The thickness of the substrate is preferably from 20 to 200 $\mu$m to prepare an image transfer sheet having a low manufacturing cost and good feeding property in image forming apparatus.

In the present invention, it is preferable to use an aqueous emulsion in each of the surface layer, image transfer layer, release layer and backcoat layer because aqueous coating liquids are friendly to environment and the image transfer sheet can be manufactured at a low cost. When a coating liquid including an organic solvent is used, the organic solvent evaporates, resulting in increase of manufacturing cost, and occurrence of environmental pollution depending on the species of the organic solvent.

The method for manufacturing the image transfer sheet of the present invention using aqueous coating liquids is the following, but is not limited thereto:

(1) one or more constituents of each of the release layer, transfer layer, surface layer and backcoat layer are dissolved, dispersed or emulsified in water to prepare aqueous coating liquids for the layers; and (2) the coating liquids are coated one by one on a substrate and then dried to form the layers on the substrate, using a coating machine such as roll coaters, blade coaters, wire bar coaters, air knife coaters, rod coaters, and die coaters.

In addition, hot melt coating methods and laminate coating methods can be used for forming the layers.

An image can be formed on the image transfer sheet of the present invention by, for example, one or more of the following methods:

(1) electrophotographic recording methods;

(2) thermal transfer recording methods using a thermofusible ink or a sublimation dye ink;

(3) ink jet printing methods using an aqueous ink or a thermofusible ink;

(4) printing methods such as offset printing methods, relief printing methods, intaglio printing methods, and stencil printing methods;

(5) electrostatic recording methods;

(6) dot impact recording methods; and (7) hand writing.

The image formed on the image transfer sheet is transferred on a receiving material upon application of heat and/or pressure.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Preparation of Release Layer

The following components were mixed to prepare a release layer coating liquid A.

Formulation of Release Layer Coating A

Emulsion of room temperature crosslinking silicone rubber 10

(Tradenamed as SE-1980 Clear and manufactured by Dow Corning Toray Silicone Co., Ltd., solid content of 45%)

Water 40

The thus prepared release layer coating liquid A was coated with a wire bar on a paper having a thickness of 105 μm and dried to form a release layer having a thickness of 1.7 μm on the substrate.

Preparation of Image Transfer Layer A

The following components were mixed to prepare an image transfer layer coating liquid A.

Formulation of Image Transfer Layer Coating liquid A

Emulsion of self-crosslinking ethylene-vinyl acetate-acrylic copolymer having a methylol group 10

(Tradenamed as Polysol EF-421 and manufactured by Showa Highpolymer Co., Ltd.; the resin has solid content of 45%, glass transition temperature (Tg) of −21° C., molecular weight of from 100,000 to 200,000 and crosslinking temperature higher than 120° C.)

Emulsion of self-crosslinking ethylene-vinyl acetate-acrylic copolymer having a methylol group 10

(Tradenamed as Polysol EF-250N and manufactured by Showa Highpolymer Co., Ltd.; the resin has solid content of 50%, glass transition temperature (Tg) of 20° C., molecular weight of from 100,000 to 200,000 and crosslinking temperature higher than 120° C.)

The transfer layer coating liquid A was coated on the release layer with a wire bar and then dried to form an image transfer layer having a thickness of 30 μm on the release layer.

Preparation of Surface Layer A

The following components were mixed to prepare a surface layer coating liquid A.

Formulation of Surface Layer Coating Liquid A

Emulsion of polyester resin 10

(Tradenamed as KZA-0150F34 and manufactured by Unitika Ltd., a Japanese company; solid content of the emulsion is 30%, and glass transition temperature (Tg) of the resin is 28.4° C.)

Water 10

The surface layer coating liquid A was coated on the above-prepared transfer layer and dried to form a surface layer having a thickness of 2 μm on a dry basis.

Thus, an image transfer sheet (a) was prepared.

A sheet of the image transfer sheet (a) was set in a color copier (PRETER 550 manufactured by Ricoh Co., Ltd.) to form a color image on the surface layer. The image was clear, and had image qualities as good as those of the image formed on special paper for the color copier.

When the transfer sheet (a) having a color image thereon was overlaid on a white cotton cloth (i.e., a receiving material) such that the image contacted the cloth. The pair of sheets was pressed for 15 seconds using a thermal transfer press machine (Tradenamed as Rotary Press and manufactured by Mainichi Mark, a Japanese company) under conditions of 75 g/cm$^2$ in pressure, and 160° C. in temperature.

After the unified sheet of the transfer sheet (a) and the white cotton cloth was cooled to room temperature, the image transfer sheet (a) was peeled from the white cotton cloth (i.e., the substrate and release layer were peeled from the image transfer layer). The color image was completely transferred on the white cotton cloth together with the surface layer and the image transfer layer. No image remained on the substrate of the image transfer sheet. Thus, a clear and high quality color image could be formed on the white cloth.

When the thus prepared color image was subjected to an iron treatment using an iron whose temperature was set at a temperature for cotton, the color image was hardly damaged. In addition, the image hardly adhered to the iron.

Example 2

The procedure for preparation of the image transfer sheet in Example 1 was repeated except that the surface layer coating liquid A was replaced with the following surface layer coating liquid B.

Formulation of Surface Layer Coating Liquid B

Emulsion of styrene-acrylic resin 20

(Tradenamed as Johncryl J-352 and manufactured Johnson Polymer; slid content of the emulsion is 45%; and glass transition temperature (Tg) of the resin is 57.2° C.)

Water 10

Thus, an image transfer sheet (b) was prepared.

Example 3

The procedure for preparation of the image transfer sheet in Example 1 was repeated except that the surface layer coating liquid A was replaced with the following surface layer coating liquid C and the thickness of the surface layer was changed to 0.5 μm.

Formulation of Surface Layer Coating Liquid C

Acrylic copolymer 100

(weight ratio, methyl acrylate/methyl methacrylate, is 25/75; and glass transition temperature thereof is 36° C.)

Ethyl acetate 4892

Methanol 8

Thus, an image transfer sheet (c) was prepared.

Example 4

The procedure for preparation of the image transfer sheet in Example 1 was repeated.

On the side of the substrate opposite to the side on which the release layer was formed, the following backcoat layer coating liquid was coated to form a backcoat layer having a weight of 1 g/m$^2$ on the image transfer sheet (a).

Formulation of Backcoat Layer Coating Liquid

Emulsion of room temperature crosslinking silicone rubber 94

(emulsion tradenamed as SE-1980 Clear and manufactured by Dow Corning Toray Silicone Co., Ltd., which has a solid content of 45%, is diluted by five times with water)

Emulsion of silicone resin 6

(emulsion tradenamed as SM-7706 and manufactured by Dow Corning Toray Silicone Co., Ltd., which has a solid content of 35%, is diluted by five times with water)

Thus an image transfer sheet (d) was prepared.

Example 5

The procedure for preparation of the image transfer sheet in Example 1 was repeated except that the thickness of the surface layer was changed to 5 $\mu$m.

Thus, an image transfer sheet (e) was prepared.

Comparative Example 1

The procedure for preparation of the image transfer sheet in Example 1 was repeated except that the surface layer coating liquid A was replaced with the following surface layer coating liquid D.

Formulation of Surface Layer Coating Liquid D

Acrylic copolymer 100

(weight ratio, methyl acrylate/methyl methacrylate/butyl acrylate, is 37/49/14; and glass transition temperature thereof is 26° C.)

Ethyl acetate 4892

Methanol 8

Thus, an image transfer sheet (f) was prepared.

Comparative Example 2

The procedure for preparation of the image transfer sheet in Example 1 was repeated except that the surface layer was not formed.

Thus, an image transfer sheet (g) was prepared.

Comparative Example 3

The procedure for preparation of the image transfer sheet in Example 1 was repeated except that the surface layer was not formed and the image transfer layer coating liquid A was replaced with the following image transfer layer coating liquid B.

Formulation of Transfer Layer Coating Liquid B

Acrylic copolymer 100

(weight ratio, methyl acrylate/methyl methacrylate, is 25/75; and glass transition temperature thereof is 36° C.)

Ethyl acetate 392

Methanol 8

Thus, an image transfer sheet (h) was prepared.

Method for Evaluating the Image Transfer Sheets (1) Blocking Resistance

Each of the thus prepared image transfer sheets (a) to (h) was cut to prepare two sheets of A4 size.

One of the two sheets was overlaid with the other sheet, and the pair of sheets was preserved at 50° C. for 24 hours while applying pressure of 1 kg to the sheets. After the preservation test, the sheets were separated from the other to determine whether the sheets were blocked or not.

The blocking resistance was classified into the following three grades:

○: The sheets were not blocked.

Δ: The sheets were slightly blocked because the two sheets were peeled from the other with a noise. However, there was no problem in image qualities and physical properties of the sheets.

X: The sheets were entirely blocked and therefore could not be peeled from the other.

(2) Feeding Property

The image forming operation as described in Example 1 was performed with respect to each of the image transfer sheets (a) to (h). The image transfer sheet was observed whether the sheet was properly fed in the color copier.

The feeding property was classified into the following two grades:

○: The sheet was properly fed.

X: Mis-feeding occurred.

(3) Fixing Property of Image

The image transfer operation as described in Example 1 was performed with respect to each of the image transfer sheets (a) to (h). It was tried to peel the transferred image from the receiving material to evaluate the fixing property of the image to the receiving material.

The fixing property of the image was classified into the following two grades:

○: The image could not be peeled from the receiving material. Even when the image was peeled by force, the image was not peeled although the image was damaged.

X: The image was easily peeled from the receiving material.

The results are shown in Table 1.

| No. of image transfer sheet | Blocking resistance | Feeding property | Fixing property |
|---|---|---|---|
| (a) | ○ | ○ | ○ |
| (b) | ○ | ○ | ○ |
| (c) | ○ | ○ | ○ |
| (d) | ○ | ○ | ○ |
| (e) | ○ | ○ | ○ |
| (f) | Δ | ○ | ○ |
| (g) | X | ○ | ○ |
| (h) | ○ | ○ | X |

As can be understood from Table 1, the image transfer sheet of the present invention does not cause the blocking problem. In addition, the image transfer sheet has a combination of good feeding property in image forming apparatus and good fixing property to receiving materials.

This document claims priority and contains subject matter related to Japanese Patent Application No. 11-265019, filed on Sep. 20, 1999, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An image transfer sheet, comprising a substrate, an image transfer layer overlying one side of the substrate, and a surface layer overlying the image transfer layer wherein the surface layer has a weighted average resin glass transition temperature of from 27° C. to 100° C., wherein the image transfer layer has a thickness of from 5 μm to 100 μm and the surface layer has a thickness of from 0.1 μm to 10 μm.

2. The image transfer sheet according to claim 1, wherein the resin is a resin selected from the group consisting of polyester resins, acrylic resins, styrene-acrylic resins and butyral resins.

3. The image transfer sheet according to claim 1, wherein the image transfer sheet further comprises a backcoat layer overlying a side of the substrate opposite to the side on which the image transfer layer is located, and wherein the backcoat layer comprises a silicone compound.

4. The image transfer sheet according to claim 3 wherein the silicone compound comprises a silicone rubber.

5. The image transfer sheet according to claim 1, wherein the image transfer layer comprises a self-crosslinking polymer.

6. The image transfer sheet according to claim 5, wherein the self-crosslinking polymer has at least one functional group selected from the group consisting of a methylol group, an alkoxymethyl group, a carboxyl group, an epoxy group, a hydroxy group, an amide group, a methylol acrylamide group, and a vinyl group.

7. The image transfer sheet according to claim 5, wherein the self-crosslinking polymer comprises a first self-crosslinking polymer having a glass transition temperature not lower than 0° C. and a second self -crosslinking polymer having a glass transition temperature lower than 0° C.

8. The image transfer sheet according to claim 5, wherein the self-crosslinking polymer comprises a first self-crosslinking polymer having a weight average molecular weight of from 10,000 to 500,000 and a second self-crosslinking polymer having a weight average molecular weight of from 10,000,000 to 60,000,000.

9. An image transfer sheet comprising a substrate, an image transfer layer overlying one side of the substrate, and a surface layer overlying the image transfer layer and comprising a plurality of resins, wherein each of the plurality of resins has a glass transition temperature, and wherein the plurality of resins have a weighted average glass transition temperature of from 27° C. to 100° C.

10. The image transfer sheet according to claim 9, wherein the plurality of resins comprise at least one resin selected from the group consisting of polyester resins, acrylic resins, styrene resins and butyral resins.

11. The image transfer sheet according to claim 9, wherein the surface layer has a thickness of from 0.1 μm to 10 μm.

12. The image transfer sheet according to claim 9, wherein the image transfer sheet further comprises a backcoat layer overlying a side of the substrate opposite to the side on which the image transfer layer is located, and wherein the backcoat layer comprises a silicone compound.

13. The image transfer sheet according to claim 12, wherein silicone compound comprises a silicone rubber.

14. The image transfer sheet according to claim 9, wherein the image transfer layer comprises a self-crosslinking polymer.

15. The image transfer sheet according to claim 14, wherein the self-crosslinking polymer has at least one functional group selected from the group consisting of a methylol group, an alkoxymethyl group, a carboxyl group, an epoxy group, a hydroxy group, an amide group, a methylol acrylamide group, and a vinyl group.

16. The image transfer sheet according to claim 14, wherein the self-crosslinking polymer comprises a first self-crosslinking polymer having a glass transition temperature not lower than 0° C. and a second self-crosslinking polymer having a glass transition temperature lower than 0° C.

17. The image transfer sheet according to claim 14, wherein the self-crosslinking polymer comprises a first self-crosslinking polymer having a weight average molecular weight of from 10,000 to 500,000 and a second self-crosslinking polymer having a weight average molecular weight of from 10,000,000 to 60,000,000.

18. The image transfer sheet according to claim 9, wherein the image transfer layer has a thickness of from 5 μm to 100 μm.

19. An image forming method comprising: providing an image transfer sheet comprising a substrate, an image transfer layer overlying one side of the substrate, and a surface layer overlying the image transfer layer and comprising a resin having a glass transition temperature of from 27° C. to 100° C.; and forming an image on the surface layer of the image transfer sheet.

20. The image forming method according to claim 19, wherein the image comprises a toner image, and wherein the image forming method further comprises a step of:

fixing the toner image upon application of at least one of heat or pressure.

21. The image forming method according to claim 19, wherein the image is formed on the surface layer by a thermal transfer method, and wherein the image comprises a thermofusible ink.

22. The image forming method according to claim 19, wherein the image is formed on the surface layer by a thermal transfer method, and wherein the image comprises a sublimation dye ink.

23. The image forming method according to claim 19, wherein the image is formed on the surface layer by an ink jet printing method using an aqueous ink.

24. The image forming method according to claim 19, wherein the image is formed by an ink jet printing method using a thermofusible ink.

25. The image forming method according to claim 19, wherein the resin comprises a resin selected from the group consisting of polyester resins, acrylic resins, styrene resins and butyral resins.

26. The image forming method according to claim 19, wherein the surface layer has a thickness of from 0.1 μm to 10 μm.

27. The image forming method according to claim 19, wherein the image transfer sheet further comprises a backcoat layer overlying a side of the substrate opposite to the side on which the image transfer layer is located, and wherein the backcoat layer comprises a silicone compound.

28. The image forming method according to claim 27, wherein silicone compound comprises a silicone rubber.

29. The image forming method according to claim 19, wherein the image transfer layer comprises a self-crosslinking polymer.

30. The image forming method according to claim 29, wherein the self-crosslinking polymer has at least one functional group selected from the group consisting of a methylol group, an alkoxymethyl group, a carboxyl group, an epoxy group, a hydroxy group, an amide group, a methylol acrylamide group, and a vinyl group.

31. The image forming method according to claim 29, wherein the self-crosslinking polymer comprises a first self-crosslinking polymer having a glass transition temperature not lower than 0° C. and a second self-cross linking polymer having a glass transition temperature lower than 0° C.

32. The image forming method according to claim 29, wherein the self-crosslinking polymer comprises a first self-crosslinking polymer having a weight average molecular weight of from 10,000 to 500,000 and a second self-crosslinking polymer having a weight average molecular weight of from 10,000,000 to 60,000,000.

33. The image forming method according to claim 19, wherein the image transfer layer has a thickness of from 5 μm to 100 μm.

34. The image forming method according to claim 19, wherein said resin is a plurality of resins, wherein each of the plurality of resins has a glass transition temperature, and wherein the plurality of resins have a weighted average glass transition temperature of from 27° C. to 100° C.

35. An image transfer method comprising:

providing an image transfer sheet comprising a substrate, a transfer layer overlying one side of the substrate, and a surface layer overlying the transfer layer and comprising a resin having a glass transition temperature of from 27° C. to 100° C.;

forming an image on the surface layer of the image transfer sheet;

bringing the image transfer sheet into contact with a receiving material such that the image contacts the receiving material while applying at least one of heat or pressure to the image transfer sheet; and peeling the substrate from the image transfer sheet to transfer the image on the receiving material together with the surface layer and the image transfer layer.

36. The image transfer method according to claim 35, wherein the resin comprises a resin selected from the group consisting of polyester resins, acrylic resins, styrene resins and butyral resins.

37. The image transfer method according to claim 35, wherein the surface layer has a thickness of from 0.1 μm to 10 μm.

38. The image transfer method according to claim 35, wherein the image transfer sheet further comprises a backcoat layer overlying a side of the substrate opposite to the side on which the image transfer layer is located, and wherein the backcoat layer comprises a silicone compound.

39. The image transfer method according to claim 38, wherein silicone compound comprises a silicone rubber.

40. The image transfer method according to claim 35, wherein the image transfer layer comprises a self-crosslinking polymer.

41. The image transfer method according to claim 40, wherein the self-crosslinking polymer has at least one functional group selected from the group consisting of a methylol group, an alkoxymethyl group, a carboxyl group, an epoxy group, a hydroxy group, an amide group, a methylol acrylamide group, and a vinyl group.

42. The image transfer method according to claim 40, wherein the self-crosslinking polymer comprises a first self-crosslinking polymer having a glass transition temperature not lower than 0° C. and a second self-crosslinking polymer having a glass transition temperature lower than 0° C.

43. The image transfer method according to claim 40, wherein the self-crosslinking polymer comprises a first self-crosslinking polymer having a weight average molecular weight of from 10,000 to 500,000 and a second self-crosslinking polymer having a weight average molecular weight of from 10,000,000 to 60,000,000.

44. The image transfer method according to claim 35, wherein the image transfer layer has a thickness of from 5 μm to 100 μm.

45. The image transfer method according to claim 35, wherein the resin is a plurality of resins, wherein each of the plurality of resins has a glass transition temperature, and wherein the plurality of resins have a weighted average glass transition temperature of from 27° C. to 100° C.

* * * * *